US005264862A

United States Patent [19]

Kumpfbeck

[11] Patent Number: 5,264,862

[45] Date of Patent: Nov. 23, 1993

[54] HIGH-ISOLATION COLLOCATED ANTENNA SYSTEMS

[75] Inventor: Richard J. Kumpfbeck, Huntington, N.Y.

[73] Assignee: Hazeltine Corp., Greenlawn, N.Y.

[21] Appl. No.: 804,444

[22] Filed: Dec. 10, 1991

[51] Int. Cl.[5] ..... H01Q 21/28; H01Q 9/34; H01Q 9/18

[52] U.S. Cl. ..... 343/853; 343/799; 343/820

[58] Field of Search ..... 343/725, 727, 844, 726, 343/728, 799, 800, 820, 846, 848, 850, 853, 878, 888, 844; 333/120

[56] References Cited

U.S. PATENT DOCUMENTS

| | | | |
|---|---|---|---|
| 4,749,969 | 6/1988 | Boire et al. | 333/120 |
| 4,870,420 | 9/1989 | Apostolos | 342/432 |
| 4,992,761 | 2/1991 | Seely et al. | 333/120 |

FOREIGN PATENT DOCUMENTS

| | | | |
|---|---|---|---|
| 0454582 | 10/1991 | European Pat. Off. | 343/799 |
| 2757325 | 7/1979 | Fed. Rep. of Germany | 343/727 |
| 2576152 | 7/1986 | France | 343/799 |
| 0024605 | 1/1989 | Japan . | |

*Primary Examiner*—Rolf Hille
*Assistant Examiner*—Peter Toby Brown
*Attorney, Agent, or Firm*—E. A. Onders

[57] ABSTRACT

The need to widely separate antennas (e.g., transmit and receive antennas) for VHF radio and other applications is avoided by high-isolation antenna systems with collocated antennas and cancellation of intercoupled signals. A transmit antenna in the form of a vertical dipole can be mounted atop a mast with a receive antenna comprising a multi-element array of vertical dipoles supported on the same mast below the transmit antenna. Opposing pairs of the dipole receiving elements are located in 180° positions on opposite sides of the mast so as to be symmetrically located in the omnidirectional antenna pattern of the transmit antenna. Resulting intercoupling to the receive dipoles is equal and in-phase and is cancelled out by the antiphase combining of signals from the dipoles of each pair of the receive dipoles. Reciprocally, cancellation of coupled signals is achieved with reversal of the receive and transmit functions of the respective collocated antennas. Dipole and monopole high-isolation antenna systems can also be configured on yardarms and ground planes.

8 Claims, 8 Drawing Sheets

HIGH-ISOLATION COLLOCATED ANTENNA SYSTEMS

BACKGROUND OF THE INVENTION

This invention relates to improving the isolation between antennas located in close physical proximity where intercoupling between antennas has been a problem. More particularly, rather than seeking maximum separation of such antennas, in accordance with the invention the antennas (transmit and receive antennas, for example) are collocated as an antenna system with isolation enhanced by cancellation of coupled signals.

Where applications require multiple VHF radios and antennas in shipboard applications, previous approaches have relied upon the mounting of antennas at different locations on the ship chosen to provide the greatest possible physical separations. However, faced with limitations of ship dimensions, available mounting locations and multipath reflections from structural elements, the resulting multiple antenna systems have achieved poor, or, at best, moderate isolation between the antennas. These limitations of prior antenna arrangements are documented in Naval Research Laboratory Technical Memorandum 7550-401a, 11 Dec. 1985, which concludes that, for most ships, available antenna locations are such that it is anticipated that isolation only on the order of 20 to 40 dB can be achieved over the 30 to 88 MHz VHF range. Similar problems exist in other applications of land-based systems and systems for other frequency bands where large physical spacings between antenna locations are not practical or not possible.

It is, therefore, an object of the present invention to provide improved antenna systems which achieve high signal isolation between two antennas, without requiring isolated location of the antennas and, more particularly, such antenna systems able to achieve 50 to 60 dB isolation over a 30 to 88 MHz bandwidth in a shipboard installation environment.

It is a further object to provide high-isolation antenna systems, such as transmit/receive antenna systems, wherein separate transmit and receive antennas are collocated and arranged so that intercoupling effects between the antennas are cancelled to provide increased operational isolation.

It is also an object to provide dual antenna systems having omnidirectional coverage and supported on a single mast, wherein a first dipole type antenna may be supported on the mast above a second antenna that includes multiple dipoles arranged symmetrically around the mast, with high isolation achieved by the combination of the vertical separation between the antennas and cancellation of signals coupled between the antennas.

SUMMARY OF THE INVENTION

In accordance with the present invention, a high-isolation collocated antenna system includes a first vertical dipole antenna providing an azimuth radiation pattern that is substantially omnidirectional with areas of radially symmetrical signal strength and a second antenna, displaced in elevation from said first antenna. The second antenna includes two antenna element pairs with each pair comprising two vertical dipole elements laterally spaced and substantially symmetrically positioned in areas of radially symmetrical signal strength of the first antenna. The antenna system also includes signal cancelling means, coupled to the second antenna, for combining signals received by the two vertical dipole elements of each antenna element pair in an out of phase relationship for substantially cancelling signals coupled to each antenna element pair from the first antenna and signal combining means, coupled to the signal cancelling means, for combining portions of signals received by each antenna element pair to provide output signals including signal portions from all antenna elements of the second antenna. The result is that cancellation is achieved with respect to signals coupled to the second antenna from the first antenna, or to the first antenna from the second antenna, enabling use of the first antenna for signal transmission (or reception) and the second antenna for signal reception (or transmission) in close proximity with effective isolation.

Also in accordance with the invention, in a high-isolation antenna system as described above, the signal combining means combines portions of received signals for providing a first output signal representative of an azimuth antenna pattern with 360° progressive clockwise phase variation and a second output signal representative of an azimuth antenna pattern with 360° progressive counter-clockwise phase variation, enabling the first and second output signals to be independently coupled to separate receivers for signal processing (or used with separate transmitters).

Further in accordance with the invention, a high-isolation antenna system may include means for coupling a selected portion of signals from the input to a transmit antenna for inclusion in output signals from a receive antenna array to cancel signals non-symmetrically coupled from the transmit antenna, for example, to compensate for multi-path reflections from obstacles within the antenna pattern of the antennas.

For a better understanding of the invention, together with other and further objects, reference is made to the following description taken in conjunction with the accompanying drawings, and its scope will be pointed out in the appended claims.

DESCRIPTION OF THE INVENTION

Figure 1:
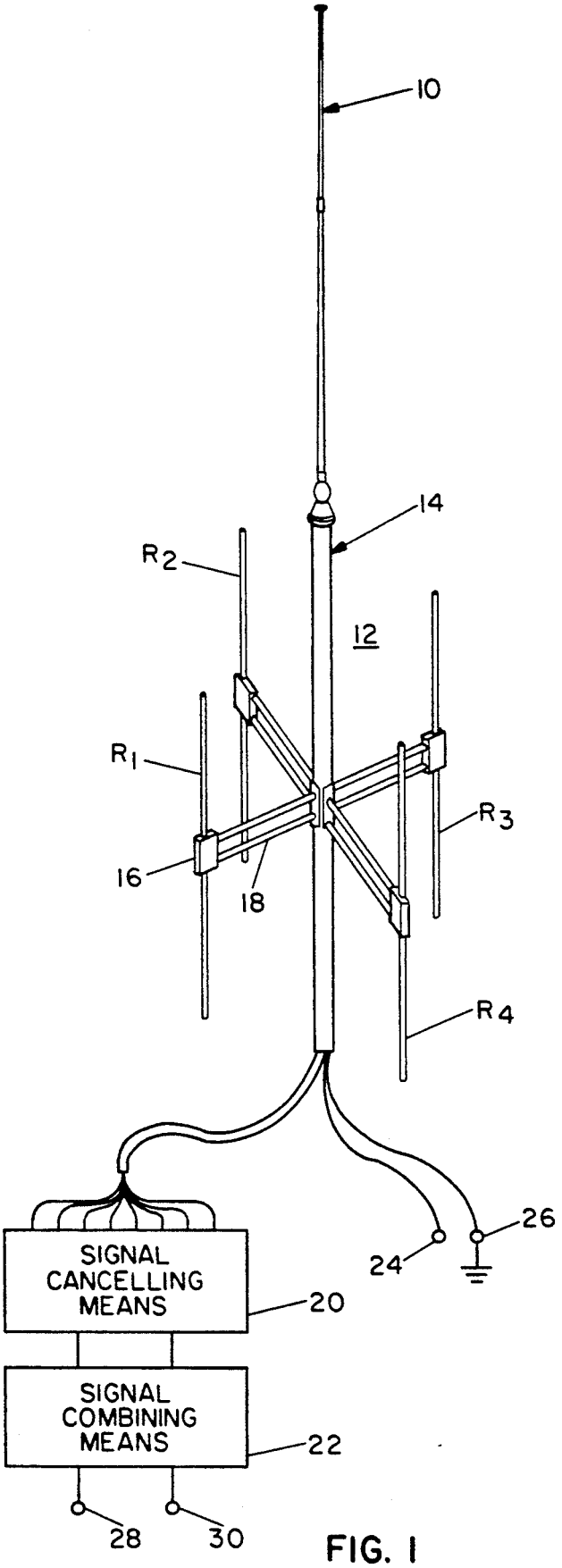
FIG. 1 shows a high-isolation collocated antenna system in accordance with the invention, which is mounted on a vertical mast.

Referring now to FIG. 1, there is shown a high-isolation collocated antenna system in accordance with the invention. As illustrated, the FIG. 1 antenna system includes first and second antennas 10 and 12, mounted on mast 14, signal cancelling means 20 and signal combining means 22.

First antenna 10 in the form of a single linear element, shown as a center-fed vertical dipole, is mounted on support means shown as mast 14. While antenna elements are reciprocal type devices usable for transmission or reception, dipole 10 in this example is used for signal transmission and provides an azimuth radiation pattern which is omnidirectional. The omnidirectional azimuth pattern is a well-known characteristic of dipole antennas and results in areas of signal strength which are radially symmetrical from the vertical axis of the dipole 10 radially outward at any azimuth angle. This radiation pattern is characterized as radially symmetrical because at a given distance radially outward from the dipole 10 the radiation pattern of the dipole will have the same phase and amplitude, regardless of azimuth angle. In FIG. 1, the upper and lower dipole arms are shown as being fed via separate electrical feed connections for coupling signals, indicated as terminals 24 and 26. In many applications, such dipoles are typically fed via a coaxial line, with one dipole arm grounded by connection to the outer coaxial conductor.

Second antenna 12, in the form of a multi-element array, is shown as including two identical antenna element pairs with each pair comprising two vertical dipole elements. Thus, dipoles $R_1$ and $R_3$ form one element pair and dipoles $R_2$ and $R_4$ form a second element pair. As illustrated, each element pair (i.e., dipoles $R_1$ and $R_3$) includes two dipoles laterally spaced from each other and symmetrically positioned in areas of radially symmetrical signal strength within the antenna radiation pattern of the first antenna 10. As will be appreciated, the symmetrical positioning results from the placement of dipole $R_1$ below and laterally spaced from the position of dipole 10 and the placement of dipole $R_3$ at a correlating 180° position (i.e., an opposing position) on the opposite side of mast 14 on which dipole 10 is mounted. As shown, the symmetry of placement of dipole $R_3$ is completed by its positioning at the same distance below dipole 10 as is dipole $R_1$. Dipoles $R_2$ and $R_4$ form a second pair of antenna similarly as to dipoles $R_1$ and $R_3$, with the dipoles $R_2$ and $R_4$ at correlating 180° positions relative to each other and at 90° positions laterally spaced between dipoles $R_1$ and $R_3$ around the mast 14.

In FIG. 1, each of dipoles $R_{1-4}$ is shown as an identical center-fed dipole including upper and lower arms supported from a support junction, such as junction 16 of dipole $R_1$, which is in turn supported by horizontal members, such as dual members 18 of dipole $R_1$, supported from mast 14. Electrical connections for coupling signals from the upper and lower arms of each of dipoles $R_{1-4}$ are provided via the members 18 and typically continue internally or externally via mast 14 to signal cancellation means 20 and signal combining means 22, which will be described further with reference to FIG. 2. After processing in units 20 and 22 signals received by antenna 12 are provided at output terminals 28 and 30.

Figure 2:
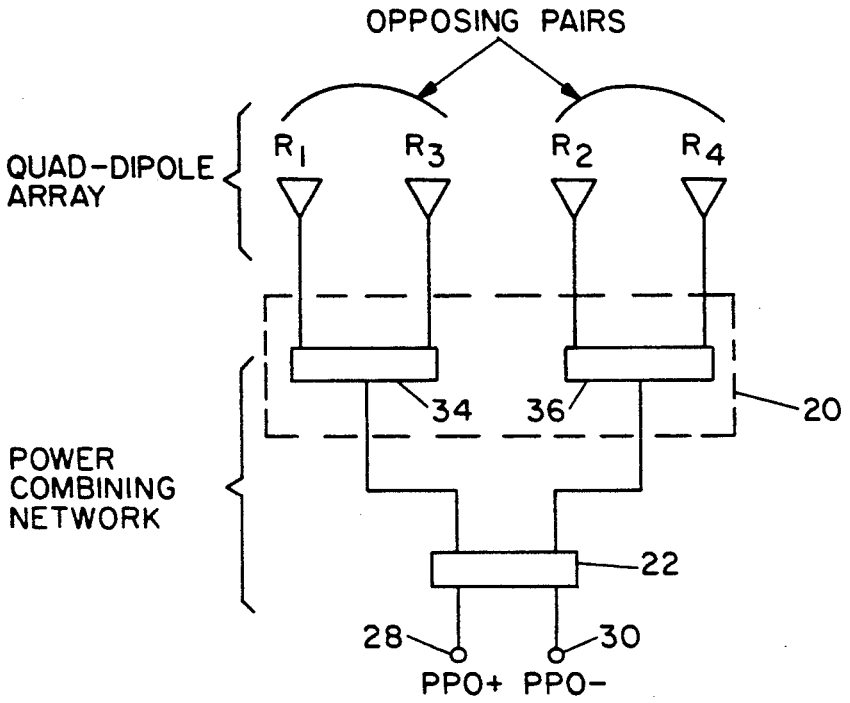
FIG. 2 is a schematic representation the FIG. 1 antenna system.

Referring now to FIG. 2, there is shown a schematic diagram of the antenna 12 and related portions of FIG. 1, but excluding antenna 10 which may be independently coupled to radio equipment for providing signals to be transmitted.

In FIG. 2, signal cancelling means 20, coupled to elements $R_{1-4}$ of second antenna 12, is provided for combining signals received by the two vertical dipole elements of each antenna element pair (i.e., first pair $R_1$, $R_3$ and second pair $R_2$, $R_4$) in an out of phase (or "antiphase") relationship to substantially cancel signals coupled to each said antenna element pair from the first antenna 10. As shown, signal cancelling means 20 includes two identical antiphase combining means 34 and 36. Means 34, for combining signals from dipoles $R_1$ and $R_3$, may be a known type of 180° hybrid coupler (see FIG. 6A) or other suitable device. An arrangement wherein means 34 comprises a pair of junction points is described with reference to FIG. 3. As further illustrated in FIG. 2, after antiphase combination to cancel signals caused by intercoupling between the first and second antennas 10 and 12, signals from antiphase combining means 34 and 36 are coupled to signal combining means 22. Unit 22, which may be a 3 dB quadrature (90°) coupler in the form of a known type of 3 dB directional coupler (see FIG. 6B) or other suitable device, provides the function of combining portions of signals received by each antenna element pair to provide output signals which include signal portions from all four dipoles $R_{1-4}$ of the second antenna 12. As will be described, in this example two separate output signals are provided at terminals 28 and 30, a first signal representative of an azimuth antenna pattern with 360° progressive clockwise phase variation at terminals 28 and a similar signal at terminals 30 representative of 360° progressive counter-clockwise phase variation.

It will be appreciated that in some applications the second antenna 12 may provide adequate performance as an array including only two elements such as dipoles $R_1$ and $R_3$, with dipoles $R_2$ and $R_4$ deleted. In this case the antenna (for use as either a receive or transmit antenna) would have an azimuth antenna pattern providing coverage basically in two quadrants, with no coverage in the directions represented by the positions of dipoles $R_2$ and $R_4$ before their removal from the FIG. 1 representation of antenna 12. Considering the FIG. 2 schematic diagram with the deletion of dipoles $R_2$ and $R_4$, it will be seen that an output signal from dipoles $R_1$ and $R_3$, after antiphase combination, is provided at the output of means 34 without any requirement for inclusion of combining means 22. The operation of the FIG. 1 antenna without dipoles $R_2$ and $R_4$ is better explained with reference to FIG. 3. In the schematic representation of FIG. 3, the upper and lower arms of the first vertical dipole antenna element 10 are shown coupled to terminals 24 and 26 for accepting signals to be transmitted. With antenna 10 used for transmission, signals from antenna 10 are unavoidably coupled to dipoles $R_1$ and $R_3$ of the second antenna 12 as schematically indicated by coupling lines 40. Since antenna 10 is a vertical dipole, it provides an omnidirectional azimuth radiation pattern with areas of bilaterally symmetrical signal strength to the left and to the right in FIG. 3. Further, since antenna 12 in this example comprises two identically constructed vertical dipoles $R_1$ and $R_3$ laterally spaced and symmetrically positioned in areas of radially symmetrical signal strength of the antenna 10, coupling to each of dipoles $R_1$ and $R_3$ will be of equal magnitude. As a result, antiphase combining means 34 need comprise only junction points 42 and 44, respectively coupling the upper arm of dipole $R_1$ to the lower arm of dipole $R_3$ and the lower arm of dipole $R_1$ to the upper arm of dipole $R_3$ of the pair of dipole elements. Assuming typical use of coaxial line, one set of dipole arms is shown grounded at junction point 44, however, in particular applications grounding can be provided at points prior to unit 34, or, without grounding, the signals at point 44 could be further processed in parallel with the signals at point 42 for later combination in known manner.

Figure 3:
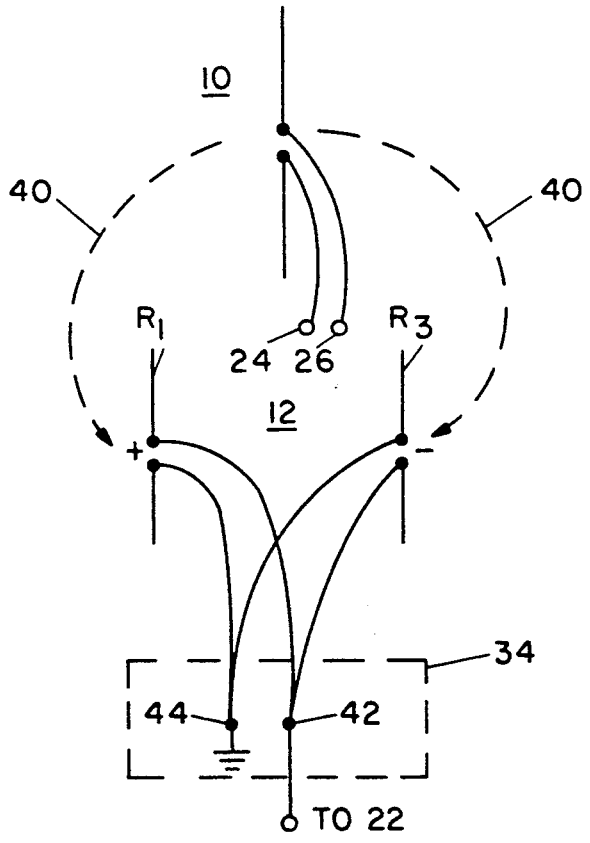
FIG. 3 is a partial schematic drawing useful in describing intercoupling effects and anti-phase connections for cancellation of intercoupled signals.

On an overall basis, the isolation between antennas 10 and 12, as illustrated, depends on two factors. First the inherent isolation resulting from the displacement of antenna 12 below antenna 10, and second, the degree of cancellation of coupled signals actually achieved. The inherent isolation for two antennas collocated one above the other as shown may typically be 20 to 25 dB. With dipoles $R_{1-4}$, which are closely identical in construction and symmetrically positioned, additional isolation in the range of 30 to 35 dB is obtained by cancellation of the coupled signals. A total net isolation 50 to 60 dB can thus be achieved in accordance with the invention. While FIG. 3 addresses only the $R_1$, $R_3$ dipole pair, the description of FIG. 3 is directly applicable to FIG. 2 on a replicated basis for the $R_2$, $R_4$ dipole pair and with the outputs of the antiphase combining units connected to 3 dB directional coupler 22.

Operationally, the four element array antenna 12 shown in FIG. 1 with the feed network shown schematically in FIG. 2 has two antenna ports represented by terminals 28 and 30 respectively. A substantially omnidirectional antenna pattern, as represented by signals from either of these two ports, may be termed a progressive phase omni ("PPO") pattern. The phase of the azimuth pattern varies with azimuth angle. Thus, at port 28, taking the excitation at dipole $R_1$ as a 0° reference, the excitation phase at dipoles $R_2$, $R_3$ and $R_4$ will be 90°, 180° and 270°, respectively (or, "PPO+"), which will be termed "progressive clockwise phase variation". Conversely, at port 30, if the excitation at dipole $R_1$ is taken as 0° (or 360°), the excitation phase at dipoles $R_2$, $R_3$ and $R_4$ will be 270°, 180° and 90°, respectively (or, "PPO−"), which will be termed "progressive counterclockwise phase variation". As a result, the FIG. 1 antenna system actually has two orthogonal omnidirectional receive ports. Each of ports 28 and 30 provides full-gain and both ports are isolated from the uniform phase omni ("UPO") vertical dipole antenna 10. An advantage of having two full-gain ports is that a different receiver can be connected to each port without the 3 dB power divider loss normally unavoidable when using a single-port receive antenna with multiple receivers. Thus, first and second output signals at ports 28 and 30 can be independently coupled to separate units of radio receiving equipment for processing of the received signals. Since antennas are bidirectional receive/transmit devices, ports 28 and 30 may alternatively be connected to separate units of transmitting equipment, with the first antenna used for reception.

In the FIG. 1 antenna, the four dipoles of the second antenna 12 are equally spaced in azimuth, with the two elements of each pair positioned opposite each other in opposed or correlating 180° positions, to provide a substantially omnidirectional azimuth pattern. In other applications of the invention the second antenna may include any desired number of pairs of elements, and the two elements of any given pair of elements need not be opposite each other in correlating 180° positions, so long as they are positioned in areas of radially symmetrical signal strength of the radiation pattern of the first antenna. Thus, for example, if the first antenna is a dipole as shown, the second antenna could take the form of one pair of dipoles with equal spacing out from the first antenna but with a 150° azimuth separation, to provide a distorted figure-eight type azimuth pattern that could be suitable for a specific application.

Also, if the first antenna has a form other than a dipole, areas of radially symmetrical signal strength may be centered only at specific azimuths (rather than existing at all azimuths as in the case of a dipole). In accordance with the invention, elements of the second antenna can be placed in those areas to provide desired cancellation of coupled signals.

Alternative Embodiments

Figure 4:
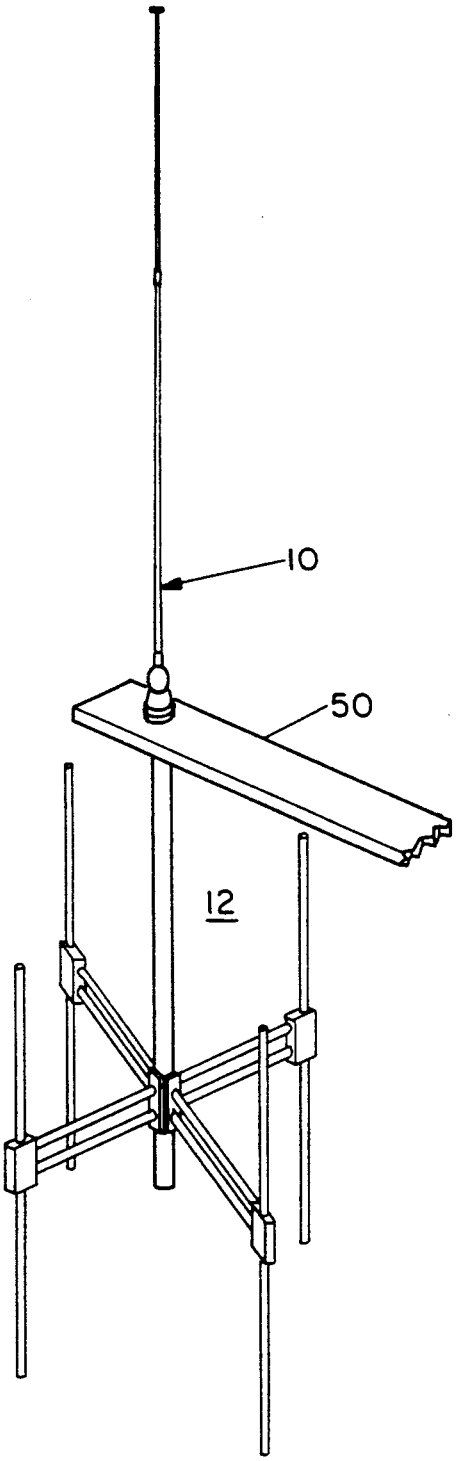
FIG. 4 shows a FIG. 1 type antenna system mounted on a horizontal yardarm.

Referring now to FIG. 4, there is illustrated an antenna system in accordance with the invention which includes first and second antennas 10 and 12, respectively mounted above and below a horizontally extending member 50, which may be a yardarm on a ship. As shown, antennas 10 and 12 corresponding to the first and second antennas of FIG. 1 are collocated above and below member 50 with their respective vertical axes substantially coincident along a common vertical line. In either the FIG. 1 or FIG. 4 antenna it may be desirable to include the signal cancelling means 20 and signal combining means 22 within the mast section supporting antenna 12, so that connections to terminals 24, 28 and 30 can be led out via the mast or yardarm.

Figure 5:
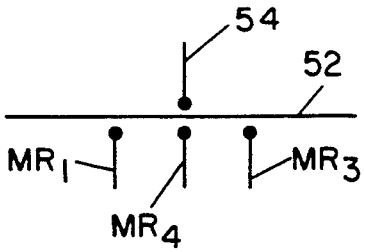
FIG. 5 shows a monopole antenna system in accordance with the invention.

FIG. 5 illustrates schematically an antenna system utilizing monopole antenna elements in accordance with the invention. As shown, FIG. 5 is a side view of a finite conductive ground plane section 52 with a first vertical monopole 54 antenna mounted above it. Below the ground plane 52 there is shown, in side view, an array of four vertical monopole antenna elements $MR_{1-4}$ arranged symmetrically around the axis of monopole 54, with monopole $MR_2$ being hidden from view by monopole $MR_4$. The theory and description of the invention provided with reference to the FIG. 1 dipole antenna system is equally applicable to FIG. 5.

Figure 6A:
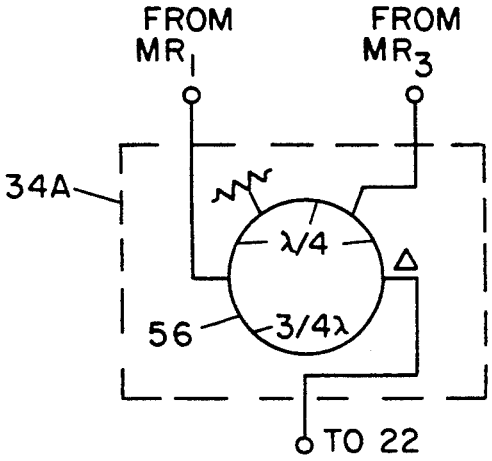
FIG. 6A is a schematic drawing of a known type of 180° hybrid coupler.

FIG. 6A schematically illustrates an alternative form of antiphase combining unit 34A utilizing a 180° hybrid coupler 56 of a known type suitable for connection to the pair of monopole elements $MR_1$ and $MR_3$ to combine signals from those elements in an out of phase relationship in order to cancel signals coupled from first monopole element 54. A unit 36A, identical to unit 34A, may be connected to monopole elements $MR_2$ and $MR_4$, with units 34A and 36A coupled to a signal combining unit 22, as in FIG. 2. While 180° hybrid coupler unit 34A is equally applicable to use with dipole antenna arrangements, hybrid couplers are typically subject to some bandwidth limitations, while the junction point antiphase combining arrangement of FIG. 3 has inherent wideband properties.

Figure 6B:
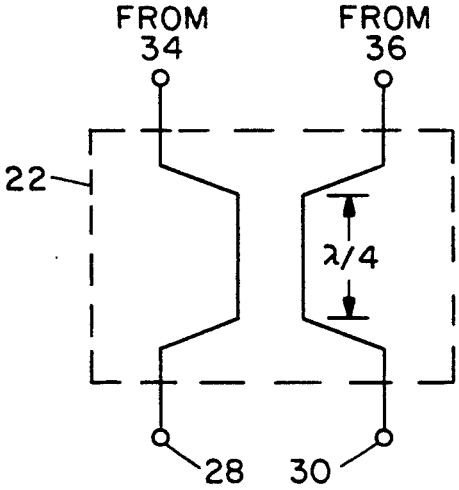
FIG. 6B is a schematic drawing of a known type of 3 dB directional coupler.

FIG. 6B schematically illustrates a form of signal combining means 22 comprising a 3 dB quadrature (90°) coupler shown as a known type of 3 dB directional coupler. As shown, the directional coupler is a reciprocal device which can be described in a transmission mode. Thus, if port 28 is excited: port 30 is isolated (receives no signal); one-half of the input signal is directly fed to the unit 34 port; and one-half of the input signal is coupled to the unit 36 port, with a 90° phase change. In this type of device parallel transmission lines are coupled over quarter wave sections and the proximity of the lines determines the strength of the coupling (50% coupling in this application). Signals input to port 30 would be similarly coupled, so that in the reception mode inputs are combined to provide the PPO+ PPO− signals described above.

Figure 7:
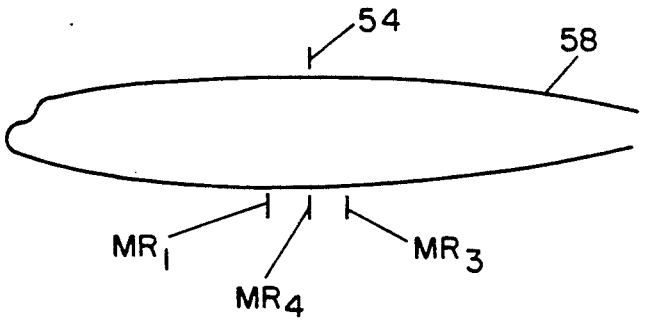
FIG. 7 shows a FIG. 5 type antenna system mounted on a aircraft.

FIG. 7 illustrates use of the FIG. 5 type antenna system in an aircraft application. Monopoles are generally more practical for aircraft applications because shorter monopole elements or blade antennas can be used. FIG. 7 shows the FIG. 5 antenna arranged to use the conductive skin of the aircraft 58 as a ground plane with monopole 54 mounted on top and the multi-element array of elements $MR_{1-4}$ mounted below the aircraft body.

In applications such as shown in FIGS. 4 and 7 it will be appreciated that while the first and second antennas are symmetrically arranged, the antenna system must operate in an environment which is not symmetrical. Thus, in FIG. 4 the yardarm 50 and in FIG. 7 the aircraft body, wings and tail section will produce multipath reflections of signals radiated by the transmit antenna, with the result that the coupled signals, such as indicated at 40 in FIG. 3, will not uniformly affect individual elements of the multi-element array comprising the second antenna. Such non-uniform inter-coupling due to multipath reflections can also be caused by reflections from other obstacles in the radiation pattern of the transmit antenna. While measured results for operation of an antenna system using the invention show high levels of isolation even in the presence of an obstacle, FIG. 8 shows an arrangement for compensating for multipath reflections in accordance with the invention.

Figure 8:
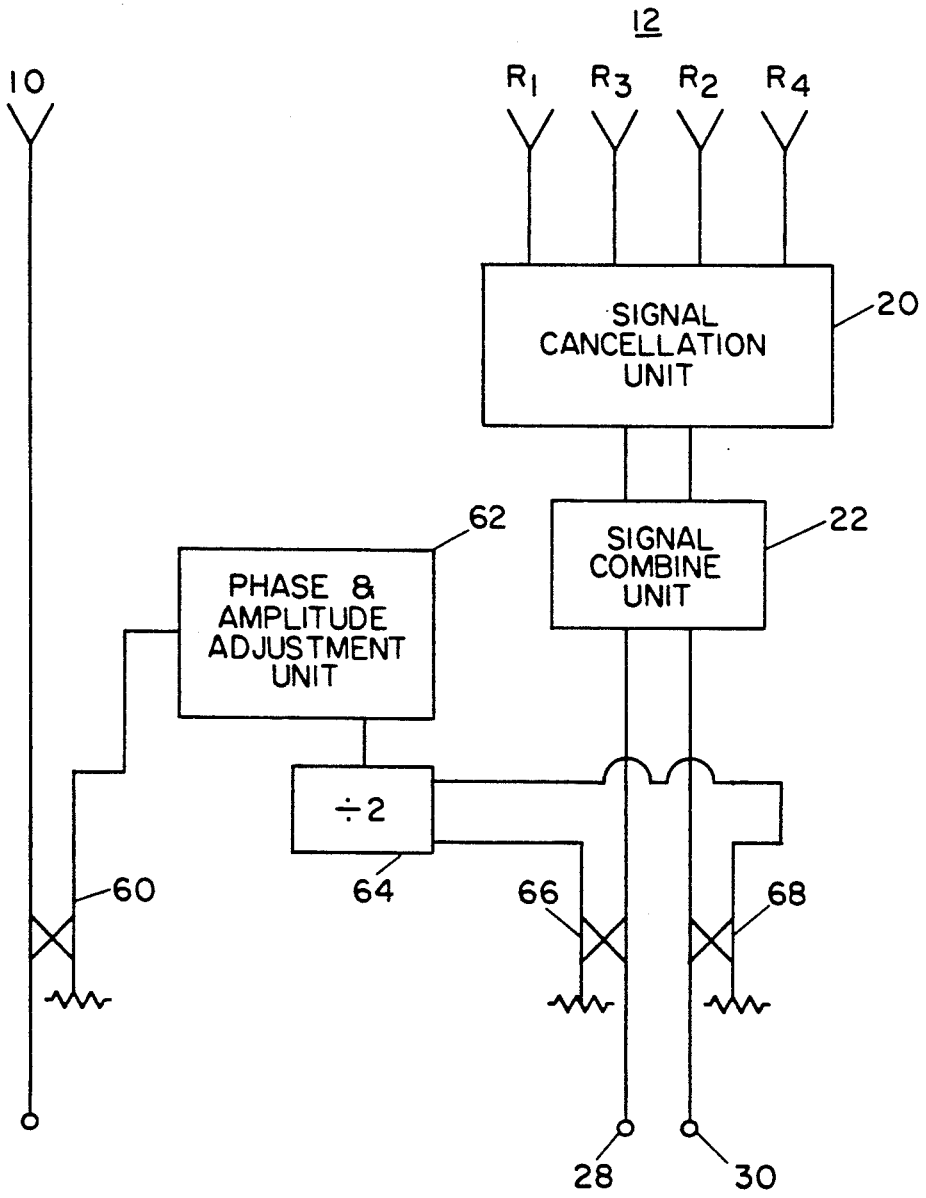
FIG. 8 is a schematic diagram of an arrangement for compensating for multipath reflections in accordance with the invention.

In FIG. 8, there is illustrated a FIG. 1 type antenna system additionally including means for coupling a selected portion of signals from the first antenna 10 for inclusion in the output signals from antenna 12 to cancel signals coupled as a result of nonuniformities in radiation pattern signal strength due to multipath reflections from obstructing objects. As shown, the coupling means includes a directional coupler 60, phase and amplitude adjustment unit 62, signal divider 64 and dual directional couplers 66 and 68. Recalling that the outputs at terminals 28 and 30 are two independent output signals with opposite progressive phase (PP0+ and PP0−), each must be similarly corrected. The correction signal is provided by coupling a small portion of the transmit antenna signals, via coupler 60, for amplitude and phase adjustment in unit 62 using appropriate known techniques to provide a correction signal which is divided in half in unit 64 and coupled into the respective output signals at terminals 28 and 30 by couplers 66 and 68, respectively. Determination of the required correction signal is made by analysis of the signals at terminal 28, for example, to determine the presence of un-cancelled signals coupled from antenna 10. Taking into account the signal division in unit 64 and coupling ratio in coupler 66, phase and amplitude of a coupled signal is adjusted in unit 62 to provide the required correction signal at its output for division in unit 64 and coupling to units 66 and 68.

Measured Performance

A FIG. 1 type antenna system was fabricated and tested as follows.

The antenna system included:

- A high-efficiency, center-fed, wideband whip antenna used as the omnidirectional transmit antenna;
- A quad-dipole mast-mounted array of center-fed elements used as the receive antenna; and
- A four-way power combining network that consists of two symmetrical antiphase power combiners and a 3-dB quadrature coupler.

The transmit antenna used in the high-isolation antenna system was a 10-foot center-fed dipole whip antenna developed by Hazeltine Corporation's Wheeler Antenna Laboratory for the U.S. Army at Fort Monmouth. This antenna operates over the full 30- to 88-MHz band without band switching. Its performance is comparable with other wideband antennas such as the AS-3900; other wideband antennas can be used with similar results.

The receive antenna used in the high-isolation antenna system is a quad-dipole design substantially in accordance with FIG. 1. The four dipoles of the receive antenna array were six feet in length and spaced 24 inches from the mast. The upper tips of the receive dipoles were two feet below the transmit antenna mounting flange. The antenna is shown to the left in FIG. 9.

(A) Antenna Isolation Measurements in a Clear Environment

Field measurements of the transmit/receive antenna transmission characteristics, defined as antenna isolation, were performed using a Hewlett Packard automatic network analyzer. The antenna was positioned on a grassy field a minimum of 100 feet distant from some fixed obstacles; this represents a clear environment. Isolation is defined as the ratio in dB of the power incident at the transmit antenna to that of the power out of the receive antenna.

Figure 10:
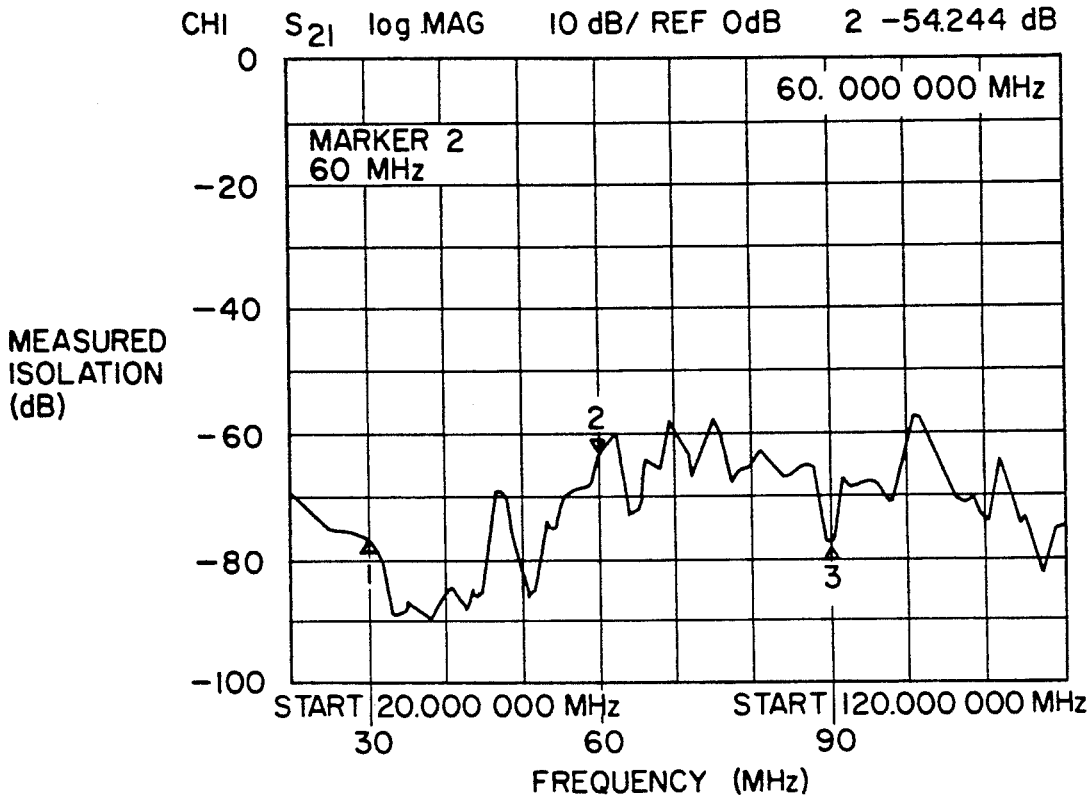
FIG. 10 shows measured isolation between antennas 10 and 12 of a FIG. 1 type antenna.

The measured swept frequency antenna isolation is presented in FIG. 10. This is a swept frequency plot from 20 to 120 MHz. The meaningful range for the equipment measured is from 40 to 90 MHz. Data below 40 MHz is at the system noise floor and cannot be interpreted properly. The data indicates that the antenna isolation between 60 and 90 MHz averages somewhat greater than 60 dB. The isolation is even greater between 40 and 60 MHz because the antenna gains are lower at those frequencies.

(B) Antenna Isolation Measurement in the Presence of an Obstacle

The measured values of antenna isolation discussed above are for the high-isolation antenna in a clear environment. The antenna coupling resulting from reflections from nearby obstacles (obstacle multipath) can affect the high isolation performance of the antenna. The actual effects of obstacle multipath may vary from installation to installation and from ship to ship.

Figure 9:
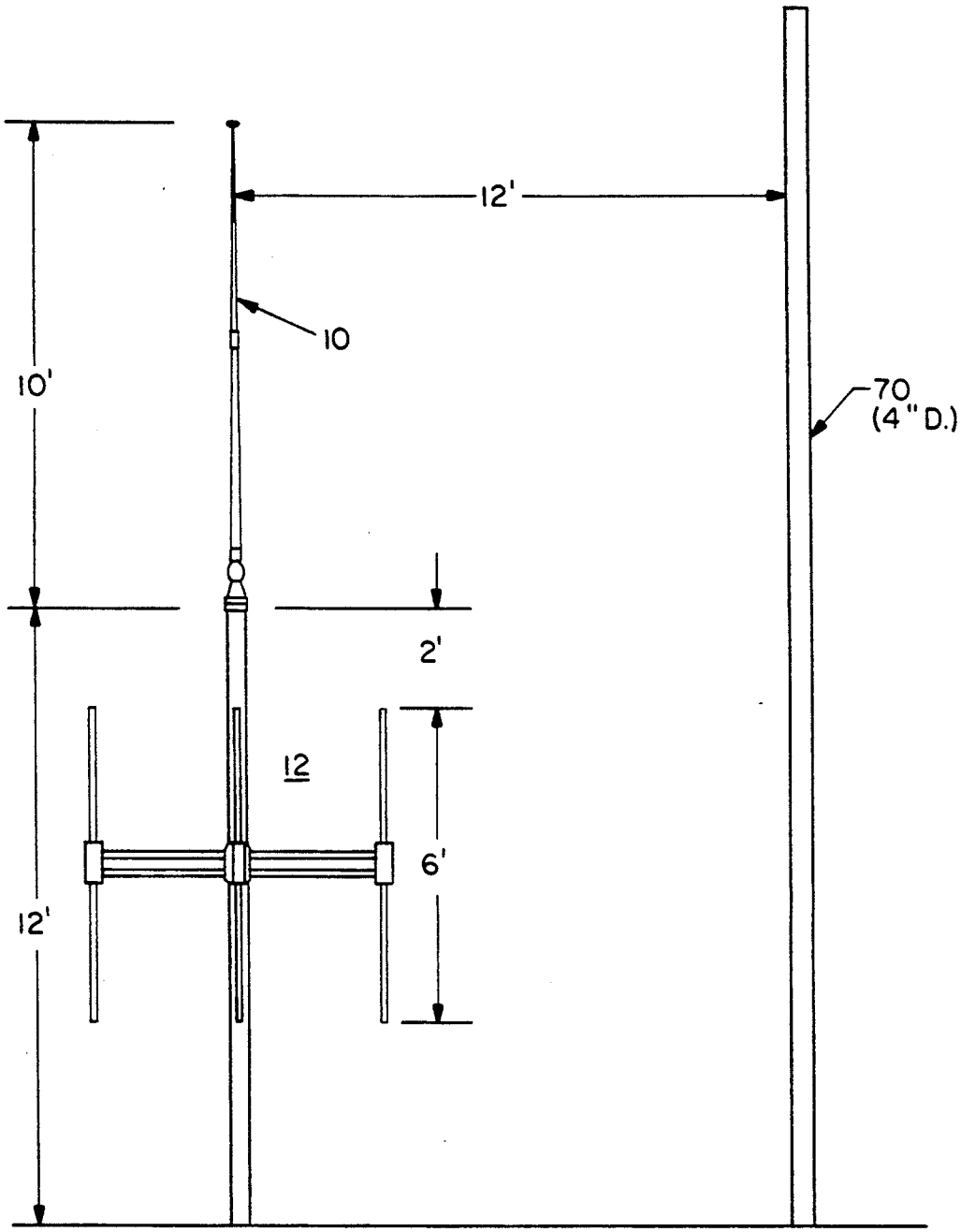
FIG. 9 shows a FIG. 1 type antenna as tested in a clear field environment and also in the presence of multipath reflections from a vertical mast shown to the right in FIG. 9.

To quantify the effects of common shipboard obstacles on the antenna isolation, field tests were performed. Measurements of the high-isolation antenna described in (A) above were performed in the presence of a four-inch diameter, 24-foot-tall metal mast 70 positioned at varying distances from the antenna. To simulate a worst-case condition for this form of obstacle, the metal mast was positioned 12 feet from the high-isolation antenna. Because the mast 70 is 24 feet tall, it actually runs the full length of the high-isolation antenna, a condition that is likely to be avoidable in actual shipboard installations. This test condition is shown in FIG. 9.

Figure 11:
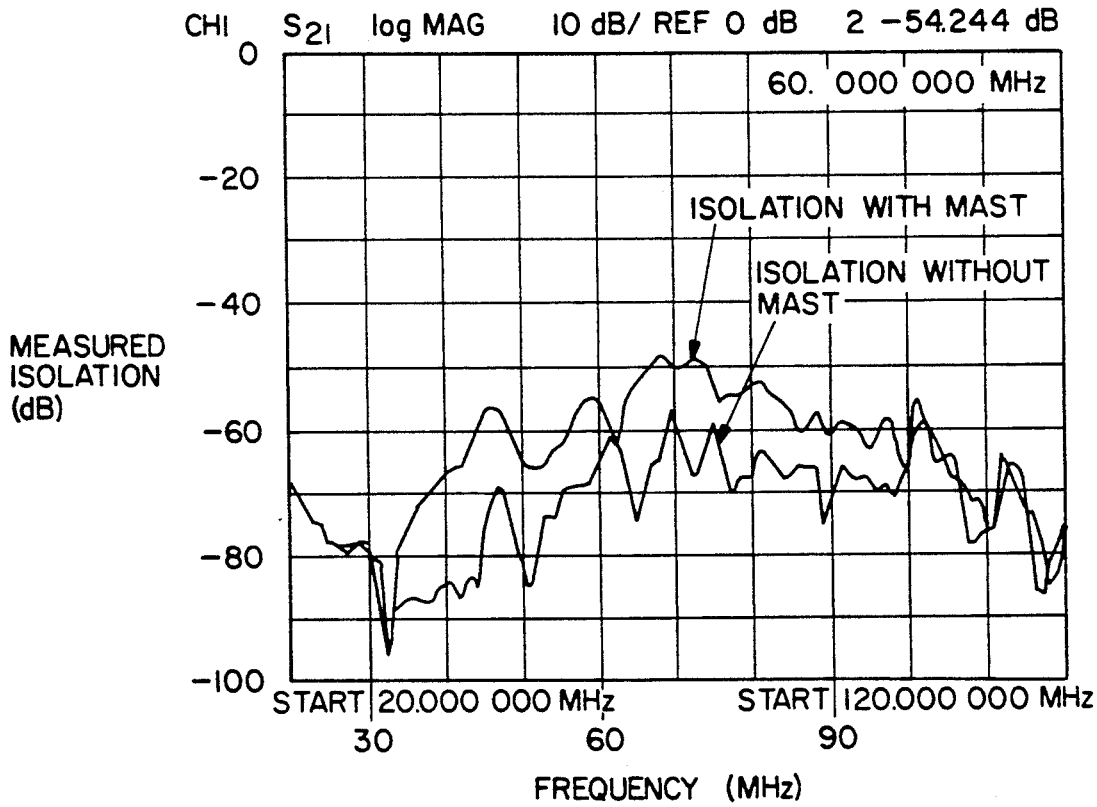
FIG. 11 shows measured antenna isolation in the presence of a mast obstruction as shown in FIG. 9.

The antenna isolation in the presence of the nearby mast 70 was measured using the same measurement technique as previously described. The measured isolation is shown in FIG. 11, with (upper curve) and without (lower curve) the mast obstacle. Again, only measurements between 40 and 90 MHz can be interpreted correctly due to equipment limitations. The above analysis shows that with a metal mast only 12 feet away and extending the full height of the high-isolation antenna, the isolation is still an average of 54 dB. Thus, performance with or without significant multipath reflections exceeds the isolation achievable with prior arrangements as discussed in the 1985 NRL Tech Memo referred to above. As tested, the antenna did not include the compensation arrangement as described with reference to FIG. 8, which could have been incorporated for achieving even higher isolation in presence of the obstacle 70.

Antenna Patterns

Figure 12A:
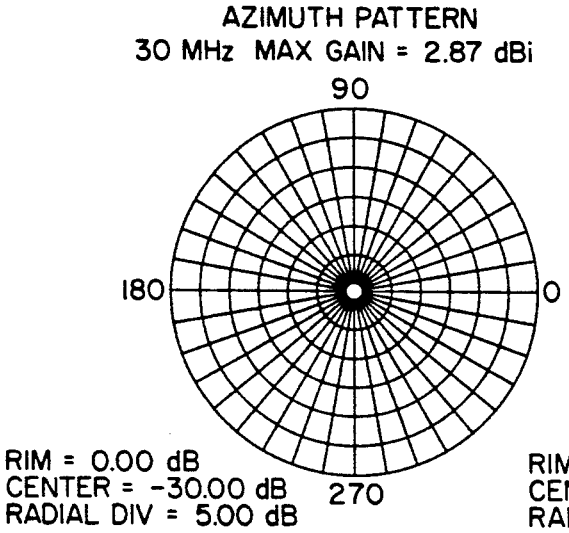
FIGS. 12A–E are plots of computed receive antenna array azimuth and elevation antenna patterns.
Figure 12B:
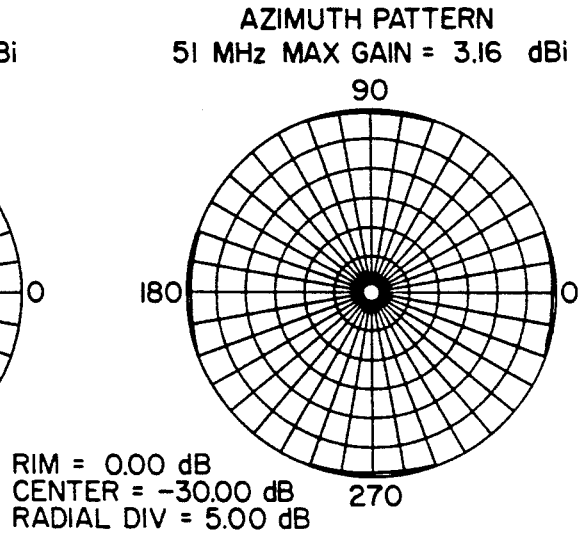
Figure 12C:
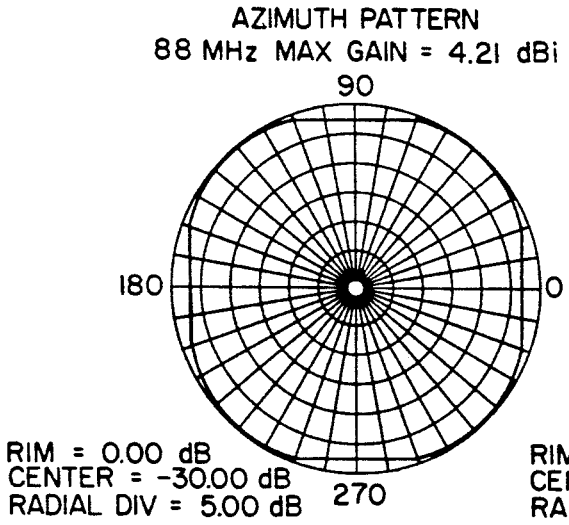

Antenna patterns were computed for a four dipole receive array antenna similar to antenna 12 as shown in FIG. 1, having dipoles $R_{1-4}$ with a length of eight feet, two inches, spaced 36 inches from mast 14. The azimuth patterns in free space at 30, 51 and 88 MHz are shown in FIGS. 12A–F. (Note that in FIG. 12A the antenna pattern contour is substantially coincident with the 0.00 dB rim circle.) The azimuth patterns in FIGS. 12A–C are nominally omnidirectional and exhibit a small and generally acceptable ripple of ±0.1 dB at 30 MHz as shown in FIG. 12A, increasing to ±1.2 dB at 88 MHz as shown in FIG. 12C. The azimuth ripple characteristics do not include effects of directional coupler 22. A non-ideal coupler would be expected to have a small effect on azimuth ripple performance, but would not affect the isolation characteristics of the antenna system. Junction points, such as 42 and 44 in FIG. 3, used to combine dipole arm signals are inherently broadband in nature.

Figure 12D:
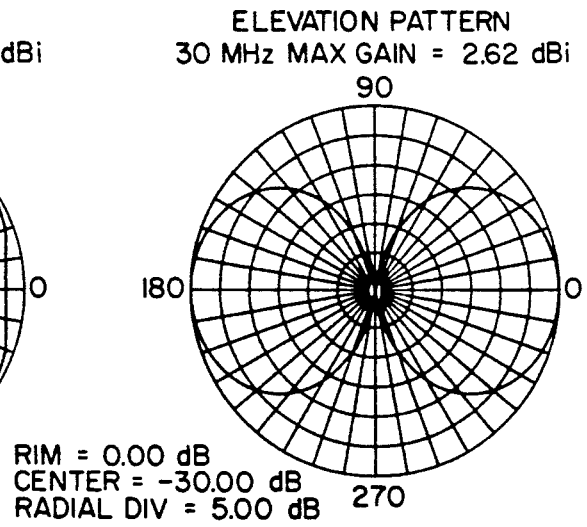
Figure 12E:
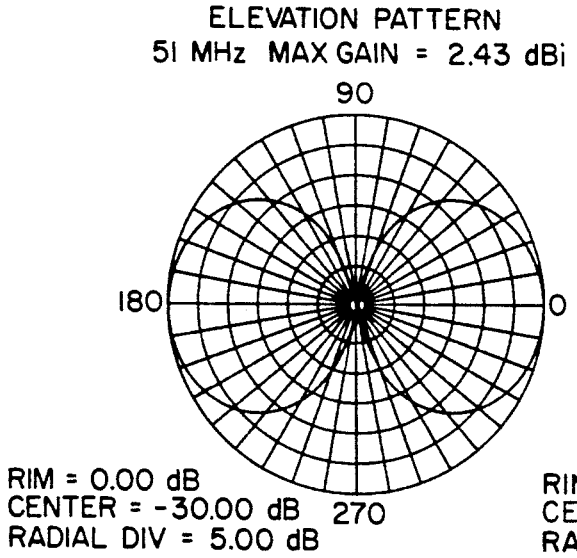
Figure 12F:
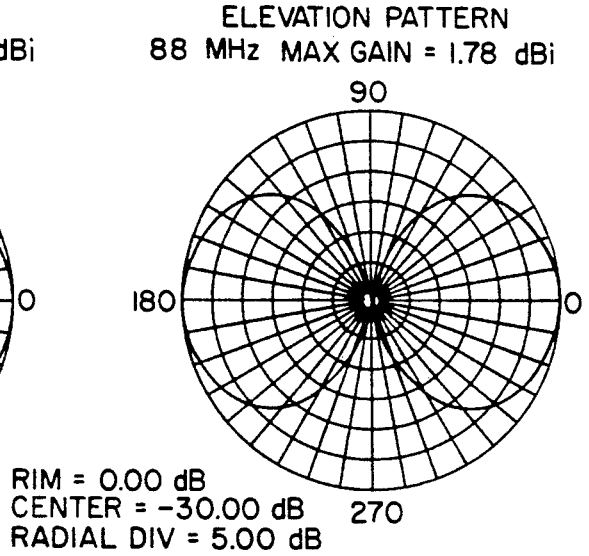

The elevation patterns for the $R_{1-4}$ dipole array, as shown in FIGS. 12D–F at 30, 51 and 88 MHz, respectively, are nominally equivalent to the expected elevation pattern of a single dipole element. The directive gain is indicated for each of the patterns in FIGS. 12A–F.

SUMMARY

High-isolation antenna systems in accordance with the invention provide the following features/benefits. The antenna system:

- Consists of a single, collocated, omnidirectional, transmit/receive antenna system. Only one shipboard location is required. The antenna system is suitable for yardarm mounting.
- Provides extremely high antenna isolation that solves the cosite interference problem. More than 60 dB isolation has been demonstrated in a clear environment and more than 50 dB isolation in an obstacle multipath environment.
- Has two orthogonal omnidirectional modes that have full antenna gain. These two receive antenna ports are used in a multiple receiver system and avoid a 3 dB power splitter loss.
- Includes transmit and receive antennas which are broadband and require no electrical or mechanical tuning.
- Is a fundamentally simple antenna system that can be produced at a reasonable cost.

While there have been described what are believed to be the preferred embodiments of the invention, those skilled in the art will recognize that other and further modifications and variations may be made without departing from the invention and it is intended to claim all such modifications and variations as fall within the scope of the invention.

I claim:

1. A high-isolation collocated antenna system, comprising:

a first antenna providing an azimuth radiation pattern which is substantially omnidirectional with areas of radially symmetrical signal strength;

a second antenna, displaced in elevation from said first antenna, including two antenna element pairs with each said pair comprising: first and second vertical dipole elements laterally spaced and substantially symmetrically positioned in areas of radially symmetrical signal strength of said first antenna; a first signal conductor for feeding signals from an upper arm of said first vertical dipole element; and a second signal conductor for feeding signals from a lower arm of said second vertical dipole element;

signal cancelling means, coupled to said second antenna, including two junction points each of which directly connects said first and second signal conductors of only one of said two antenna element pairs, for substantially cancelling signals coupled to each said antenna element pair from said first antenna; and signal combining means, coupled to said two junction points of said signal cancelling means, comprising directional coupler means for coupling together signals from said junction points to provide a first output signal representing a clockwise phased combination of signal portions from each said dipole element of said second antenna and a second output signal representing a counterclockwise phased combination of signal portions from each said dipole element of said second antenna.

2. A high-isolation collocated antenna system, comprising:

a first antenna providing an azimuth radiation pattern which is substantially omnidirectional with areas of radially symmetrical signal strength;

a second antenna, displaced in elevation from said first antenna, including two antenna element pairs with each said pair comprising: first and second vertical dipole elements laterally spaced and substantially symmetrically positioned in areas of radially symmetrical signal strength of said first antenna; a first signal conductor for feeding signals from an upper arm of said first vertical dipole element; and a second signal conductor for feeding signals from a lower arm of said second vertical dipole element;

signal cancelling means, coupled to said second antenna, including two junction points each of which directly connects said first and second signal conductors of only one of said two antenna element pairs, for substantially cancelling signals coupled to each said antenna element pair from said first antenna; and signal combining means, coupled to said two junction points of said signal cancelling means, for combining portions of signals received by each said antenna element pair to provide output signals including signal portions from all antenna elements of said second antenna for providing a first output signal representative of an azimuth antenna pattern with 360° progressive clockwise phase variation and a second output signal representative of an azimuth antenna pattern with 360° progressive counterclockwise phase variation;

whereby said first and second output signals may be independently coupled to separate receivers for signal processing.

3. An antenna system as in claim 2, additionally comprising means for coupling a selected portion of signals from said first antenna for inclusion in said output signals to cancel signals non-symmetrically coupled from said first antenna to said second antenna as a result of nonuniformities in radiation pattern signal strength, whereby compensation may be provided for multi-path reflections caused by objects within the antenna pattern of said antennas.

4. A high-isolation collocated antenna system, comprising:

a first vertical dipole antenna providing an azimuth radiation pattern which is substantially omnidirectional with areas of radially symmetrical signal strength;

a second antenna, displaced in elevation from said first antenna, including two antenna element pairs with each said pair comprising two vertical dipole elements laterally spaced and substantially symmetrically positioned in areas of radially symmetrical signal strength of said first antenna;

signal cancelling means, coupled to said second antenna, for combining signals received by said two vertical dipole elements of each said antenna element pair in an out-of-phase relationship for substantially cancelling signals coupled to each said antenna element pair from said first antenna;

signal combining means, coupled to said signal cancelling means, for combining portions of signals received by each said antenna element pair to provide output signals including signal portions from all antenna elements of said second antenna; and means for coupling a selected portion of signals from said first antenna for inclusion in said output signals to cancel signals non-symmetrically coupled from said first antenna to said second antenna as a result of nonuniformities in radiation pattern signal strength, whereby compensation may be provided for multi-path reflections caused by objects within the antenna pattern of said antennas.

5. A high-isolation collocated antenna system, comprising:

a first vertical dipole antenna providing an azimuth radiation pattern which is substantially omnidirectional with areas of radially symmetrical signal strength;

a second antenna including two vertical dipole elements laterally spaced and substantially symmetrically positioned in areas of radially symmetrical signal strength of said first antenna;

signal cancelling means, coupled to said second antenna, for forming output signals by combining signals received by said two vertical dipole elements in an out-of-phase relationship for substantially cancelling signals coupled to said dipole elements from said first antenna; and means for coupling a selected portion of signals from said first antenna for inclusion in said output signals to cancel signals non-symmetrically coupled from said first antenna to said second antenna as a result of nonuniformities in radiation pattern signal strength, whereby compensation may be provided for multi-path reflections caused by objects within the antenna pattern of said antennas.

6. A high-isolation transmit/receive antenna system, comprising:

a first antenna providing an azimuth radiation pattern having areas of radially symmetrical signal strength;

a second antenna including first and second radiating elements substantially symmetrically positioned in first and second areas of radially symmetrical signal strength of said first antenna, a first signal conductor for feeding signals of a first phase from said first radiating element, and a second signal conductor for feeding signals of opposite phase, relative to said first phase, from said second radiating element;

signal cancelling means, coupled to said second antenna, including a junction point directly connecting said first and second signal conductors to directly combine, in an out-of-phase relationship, signals associated with said two radiating elements, for substantially cancelling signals coupled between said first and second antennas to provide output signals; and means for coupling a selected portion of signals from said first antenna for inclusion in said output signals to cancel signals non-symmetrically coupled from said first antenna to said second antenna as a result of nonuniformities in radiation pattern signal strength, whereby compensation may be provided for multi-path refections caused by objects within the antenna pattern of said antennas.

7. A high-isolation collocated antenna system, comprising:

a first antenna providing an azimuth radiation pattern which is substantially omnidirectional with areas of radially symmetrical signal strength;

a second antenna, displaced in elevation form said first antenna, including two antenna element pairs with each said pair comprising: first and second vertical elements laterally spaced and substantially symmetrically positioned in areas of radially symmetrical signal strength of said first antenna; a first signal conductor for feeding signals from said first vertical element; and a second signal conductor for feeding signals from said second vertical element;

a horizontally extending member upon which said first antenna is mounted so as to extend upward and upon which said second antenna is mounted below said first antenna so as to extend downward from said member, substantially co-axially with said first antenna;

signal cancelling means, coupled to said second antenna, including two junction points each of which directly connects said first and second signal conductors of only one of said two antenna element pairs, for combining said signals from said first and second vertical elements in an out-of-phase relationship for substantially cancelling signals coupled to each said antenna element pair from said first antenna; and signal combining means, coupled to said two junction points of said signal cancelling means, for combining portions of signals received by each aid antenna element pair to provide output signals including signal portions from all antenna elements of said second antenna for providing a first output signal representative of an azimuth antenna pattern with 360° progressive clockwise phase variation and a second output signal representative of an azimuth antenna pattern with 360° progressive counterclockwise phase variation;

whereby said first and second output signals may be independently coupled to separate receivers for signals processing.

8. An antenna system as in claim 7, wherein said horizontally extending member is a ground plane section, said first antenna is a vertical monopole mounted above said ground plane section and said second antenna comprises four vertical monopoles mounted below said ground plane section.

* * * * *